United States Patent [19]

Sugihara et al.

[11] Patent Number: 4,495,133

[45] Date of Patent: Jan. 22, 1985

[54] PROCESS FOR THE PRODUCTION OF PILE-SURFACED TEXTILE STRUCTURES

[75] Inventors: Taizo Sugihara; Tsuyoshi Aoki, both of Moriyama, Japan

[73] Assignee: Chisso Corporation, Osaka, Japan

[21] Appl. No.: 523,671

[22] Filed: Aug. 16, 1983

[30] Foreign Application Priority Data

Aug. 17, 1982 [JP] Japan ..... 57/141731

[51] Int. Cl.[3] ..... B32B 33/00

[52] U.S. Cl. ..... 264/504; 428/91; 428/92; 428/95; 427/348

[58] Field of Search ..... 428/85, 95, 90, 91, 428/92; 264/504; 156/72; 427/348

[56] References Cited

FOREIGN PATENT DOCUMENTS 1378638 12/1974 United Kingdom ..... 428/85
1378639 12/1974 United Kingdom ..... 428/85
1378640 12/1974 United Kingdom ..... 428/85

*Primary Examiner*—Marion E. McCamish
*Attorney, Agent, or Firm*—Fleit, Jacobson, Cohn & Price

[57] ABSTRACT

A pile-surfaced textile structure comprising a composite characterized in that a low-melting point thermoplastic resin material is fused to a backing material of an air-permeable textile structure which is not softened and thus remains substantially intact upon heating at a given temperature, and in that piles are formed from said resin material in the fibrous form.

6 Claims, 4 Drawing Figures

PROCESS FOR THE PRODUCTION OF PILE-SURFACED TEXTILE STRUCTURES

FIELD OF THE INVENTION

The present invention relates to a pile-surfaced textile structure formed with piles of thermoplastic resin and a process for the production of the same.

BACKGROUND OF THE INVENTION

Heretofore, piled textile structures have been formed of spinning and weaving of fibers, followed by raising and shearing. Alternatively, they have been prepared by fluffing adhesives-bearing backing fabrics with short fibers by means of spreading, spraying, vibration, electro-static deposition using high voltages, etc. However, such piled textile structures have imposed limitations upon the type of fibers used for fluffing, and been used in only limited fields. Furthermore, they have required large-sized apparatus involving time-consuming steps, thus leading to rise in the production costs. In view of the high costs involved, the piled textile structures are not practically used, although they have been found to possess some advantages; they may be used as filters or diapers' linings or facings. For instance, if they are used as filter, the collection efficiency would be improved by affording a density gradient thereto, and the accumulated dust would easily be removed by vibration. Having their softness, they would be best-suited for diaper materials.

As a consequence of extensive studies made to these disadvantages, it has been found that various pile surfaced textile structures comprising textile structures having diverse air-permeabilities and piles of molten thermoplastic resin formed thereon by air jetting are useful in a variety of fields, and can be prepared by means of relatively simpler apparatus.

SUMMARY OF THE INVENTION

According to one aspect of the present invention, there is provided a pile-surfaced textile structure comprising a composite characterized in that a low-melting point thermoplastic resin material is fused to a backing material of an air-permeable textile structure which is not softened and thus remains substantially intact upon heated at a given temperature, and in that piles are formed from said resin material in a fibrous form.

According to another aspect of the present invention, there is provided a process for the production of a pile-surfaced textile structure characterized by comprising the steps of preparing a composite comprising a backing material of an air-permeable textile structure which is not softened and thus remains substantially intact upon heated at a given temperature and a low-melting point thermoplastic resin material fused to one side of said backing material, said resin material being molten by heating at a given temperature; heating said composite at said given temperature to melt said resin material; and injecting an air jet through said heated composite from said textile structure, whereby said resin material is projected in the fibrous form to obtain piling.

According to a further aspect of the present invention, there is provided a process for the preparation of a pile-surfaced textile structure characterized by the steps of preparing a composite comprising an air-permeable backing material made of a high-melting linear mass, which forms a part of an air-permeable textile structure, and is not softened and remains substantially intact upon heating at a given temperature, and a low-melting point thermoplastic resin material made of a low-melting point, linear mass, which forms another part of said textile structure, and is molten by heating at said given temperature; heating said composite to said given temperature to melt said resin material; and injecting air jet through said heated composite from its one side to its other side, whereby said resin material is projected in a fibrous form to obtain piles.

BRIEF DESCRIPTION OF THE DRAWINGS

Other aspects of features of the present invention will become apparent from the following detailed description with reference to the accompanying drawings, in which: the preferred embodiments of the apparatus for the continuous preparation of pile-surfaced textile structures.

and

Figure 4:
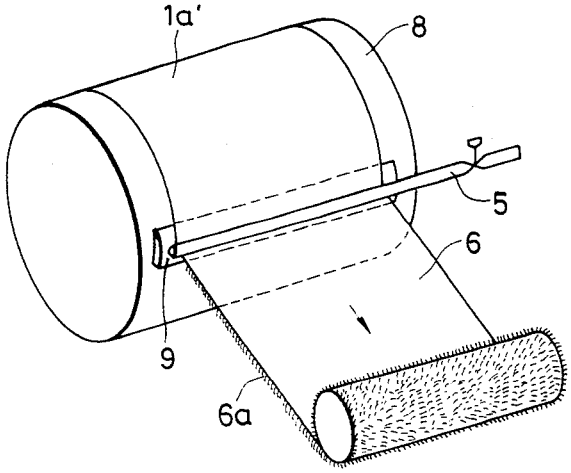

FIG. 4 being a general perspective view showing one embodiment of the apparatus for the simultaneous preparation of a textile structure and a pile-surfaced textile structure by heat or thermal fusion.

PREFERRED EMBODIMENTS OF THE PRESENT INVENTION

The term "textile structure" referred to hereinbefore and hereinafter is understood to indicate any substantially flat structures such as woven fabrics, knitted fabrics, unwoven fabrics, webs, etc.

The textile structure should have a suitable air-permeability which varies depending upon the application and pile state of the pile-surfaced textile structure as well as the type of the low-melting point thermoplastic resin used in the production process thereof and the degree of injection of the air jet applied. According to the present invention, however, the air-permeability should preferably be about 50 $cm^3/cm^2$ as measured with an air-permeability testing machine designated in JIS L 1004 (Test method for cotton fabrics). (In what follows, the permeability will be given in terms of values obtained with the same machine).

The low-melting point thermoplastic resin used for the formation of piles may be selected, on the basis given later, from the groups consisting of polyolefines such as polypropylene and polyethylene, polyesters such as polyethylene terephthalate, polyamides, polyvinyl chloride and polystyrene, or modified products thereof, or mixtures thereof. It is noted, however, that the low-melting point thermoplastic resin may include any pigments, inorganics, anti-statics, stabilizers, flame retardants etc., as long as they have no adverse influence upon the effect of the present invention.

The portion of the textile structure referred to as the backing material in the present invention maintains air-permeability, even when it is heated to a given temperature (to be defined later).

Reference is then made to the relationship between the backing material and two essential types of textile structure that are broken down on a basis of the softening or melting properties of the fibers constructing the textile structure when heated.

The first type of textile structure is entirely formed of fibers which are not softened by heating at the said given temperature. Thus, such a textile structure forms the backing material as such, since it remains substantially intact (i.e., unchanged in respect of its structure) upon heating to the said given temperature. Hereinafter, such a textile structure may be called the unsoftening textile structure. The second type of textile structure is partly formed of a high-melting linear mass undergoing no softening by heating at the said given temperature with the remaining part being formed of a low-melting point linear mass undergoing melting by heating at the said given temperature. The backing material is then provided by the high-melting point linear mass, since, when heated to the said given temperature, the high-melting point linear mass remains substantially intact, while the low-melting point linear mass melts and changes in its shape. Hereinafter, the second textile structure may be called the partly melting textile structure. The partly melting textile structure is further broken down into two types, as will be explained below. The first type of the partly melting textile structure is formed of a mixture of high-melting point fibers undergoing no softening by heating to the said given temperature as a high-melting point linear mass, and low-melting point fibers undergoing melting by heating to the said given temperature as a low-melting point linear mass. Accordingly, the backing material is then provided by at least the high-melting point fibers, since, when heated to the said given temperature, the high-melting point fibers do not soften and remain substantially intact, while the low-melting point fibers melt with the fibers changing in shape. Hereinafter, that first type of the partly melting textile structure may be called the mixed fiber textile structure. The second type of the partly melting textile structure refers to the partly melting textile structure modified in such a manner that is composed partly or wholly of composite fibers which comprise a high-melting point component undergoing no softening at the said given temperature and a low-melting point thermoplastic resin component undergoing melting at the said given temperature, and in which the surface of the composite fibers is at least partly provided with the low-melting point component. Thus, the high-melting component forms the high-melting point linear mass, while the low-melting point component forms the low-melting point linear mass. If such second type of the partly melting textile structure is heated to the said given temperature, the low-melting point component of the respective composite fibers melts, while the high-melting point component thereof will not soften with the fibers remaining substantially intact, so that the textile structure remains substantially intact. The backing material is then provided by at least the high-melting point component. It is noted that, when the second type of the partly melting textile structure includes fibers which neither soften nor change in quality by heating at the said given temperature, that fibers form a part of the backing material. Hereinafter, the second type of the partly melting textile structure may be called the composite fiber textile structure.

In the first aspect of the present invention, the low-melting point, thermoplastic resin as exemplified is fused to the backing material to form a composite. The low-melting point thermoplastic resin is projected into fibrous piles from the surface of the backing material to which it is fused. In other words, the base of this fibrous piles is fused to the backing material in spread base, and then there is no removal of piles.

When the unsoftening textile structure is used, the fibrous piles are formed by a separate thermoplastic resin. However, when use is made of the partly melting textile structure such as the mixed fiber textile structure or composite fiber textile structure, it is not always required to use separate thermoplastic resins, since piles can then be formed by the low-melting point thermoplastic resin forming the parts other than the backing material.

To ensure that the fibrous piles of the low-melting point, thermoplastic resin is fused to the backing material, it is required that only the low-melting point thermoplastic resin melt without causing softening in the backing material, viz., with the backing material remaining substantially intact. In other words, it is required that the melting point of the pile-forming low-melting point thermoplastic resin be lower than the softening or deteriorating point of the backing material. Hereinafter, that softening or deteriorating point may be called the destruction point. In this connection, the term "given temperature" is understood to indicate a temperature higher than the melting point of the low-melting point thermoplastic resin and lower than the destruction point of the backing material, i.e., between both points. It is thus required to choose the low-melting point thermoplastic resin materials having a melting point that is lower than the destruction point of the backing material. Better results will be obtained, when a difference between both points is larger. Various materials may be used as the backing material; however, thermoplastic resins are preferable, since to them are well fused the pile-forming low-melting point thermoplastic resin. Such thermoplastic resins include polyamides, polyesters, polyolefines, polyvinyl chloride, etc.

The above-mentioned essential two or three textile structures may be used alone or in combination. If required, the piles may be formed by the additional use of separate thermoplastic resins.

The second aspect of the present invention will now be described in detail with reference to the drawings.

The process of the present invention generally involves the steps of forming a composite, heating the composite and injecting an air jet through the composite. These steps may be taken separately; though they are preferably taken in a continuous manner.

Referring first to the formation of a composite 1, it is substantially flat and formed partly or wholly of an air-permeable textile structure 1*a*. As mentioned above, the composite is comprised of a backing material and a low-melting point thermoplastic resin material for the pile-surfacing purpose. When the textile structure 1*a* is the unsoftening textile structure, a separate low-melting point thermoplastic resin material is required. When the textile structure 1*a* is the partly melting textile structure such as the mixed fiber textile structure or the composite fiber textile structure, it is possible to use the structure 1*a* per se as the composite 1. Although no separate low-melting point thermoplastic resin material is required, it may be possible to prepare another composite by the addition of it.

Figure 1:
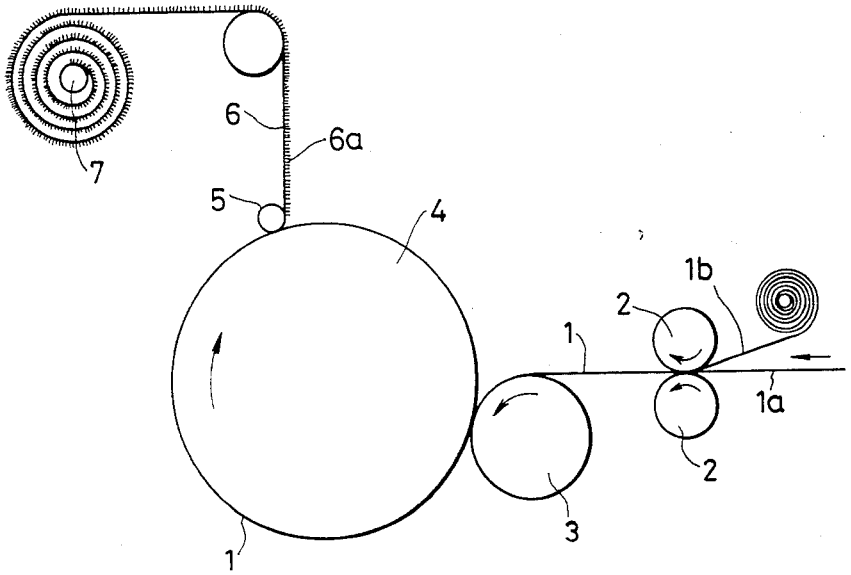
FIG. 1 illustrating the preparation of a composite composed of a textile structure on which laminated is a low-melting point thermoplastic resin film.
Figure 2:
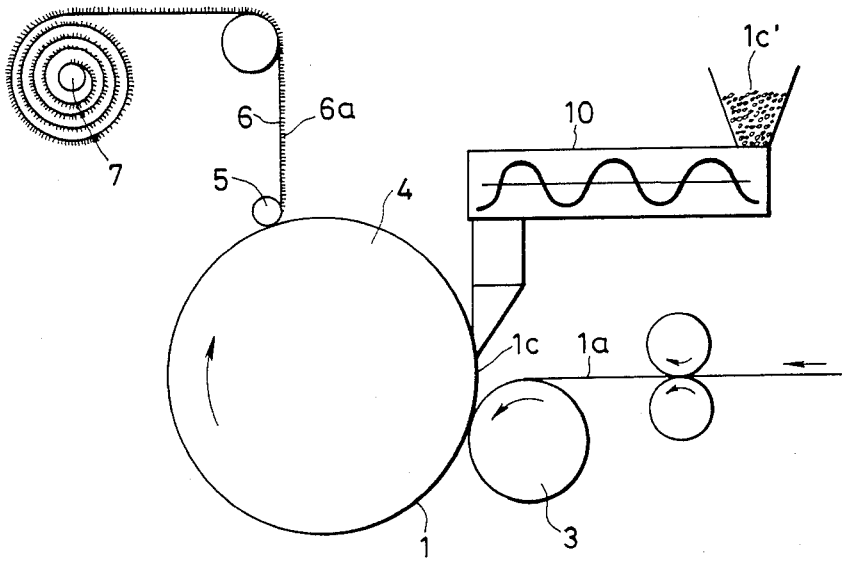
FIG. 2 illustrating the preparation of a composite composed of a textile structure on which coated is a low-melting point thermoplastic resin in the molten state.

In order to obtain the composite 1 comprising the textile structure 1*a* and a separate low-melting point thermoplastic resin material, the textile structure 1*a* is fed between laminating rolls 2, where a low-melting point thermoplastic resin film 1b is laminated thereto, as illustrated in FIG. 1. Alternatively, as illustrated in FIG. 2, a low-melting point thermoplastic resin pellet 1c' for the coating purpose is fed to a melt extruder 10, and the resultant low-melting point thermoplastic resin 1c for the coating purpose is applied over a heating roll 4 in the molten state, and the moving textile structure 1a is brought into contact and coated with the molten resins to form the composite 1.

When the textile structure 1a per se is used as the composite 1, the low-melting point thermoplastic resin may be charged without any coating or laminating treatment.

The thus formed composite 1 is fed in between a nip roll 3 and the heating roll 4, both rotating, and moved while it comes into contact with the surface of the heating roll 4. The surface of the heating roll 4 is then maintained at a temperature above the melting point of the low-melting point thermoplastic resin and below the destruction point of the backing material. In this way, the composite 1 is heated on the surface of the heating roll 4, whereby the low-melting point thermoplastic resin material is molten, while the backing material remains substantially intact without any destruction. But in the embodiment of FIG. 2, heating maintains the molten state of the coated low-melting point thermoplastic resin and thus improves the coating state thereof.

The composite 1 having its low-melting point thermoplastic resin molten reaches an air jet injector 5, and is separated from the heating roll 4. Just thereafter, say, while the low-melting point thermoplastic resin is in a moltenstate, an air jet is injected through the composite 1. When a separate low-melting point thermoplastic resin is then used, as illustrated in FIGS. 1 and 2, the air jet is injected through the composite 1 from the side of the textile structure 1a. When use is made of a composite of which the low-melting point thermoplastic resin material is composed only of the low-melting points linear mass of the partly melting textile structure, the air jet may be injected through the composite from either side. However, it is preferable that, when the heating roll 4 provides a heat source, the air jet is injected through the composite in such manner that it escapes from the side thereof to come into contact with the heating roll 4.

According to one preferred embodiment of the air jet injector 5, it comprises a tube having an inner diameter of 8 to 20 mm which is closed at one end and provided with apertures of 0.1 to 2 mm in diameter at constant pitches. Compressed air of 1 to 20 $Kg/cm^2G$ (G indicates gauge pressure) is passed through the air jet injector 5 from its open end, whereby it is jetted through composite 1 via the apertures. The low-melting point thermoplastic resin in a molten state is projected into fibrous piles 6a on the side of the composite 1 which the air leaves.

In connection with the air jet injector 5, too much increase in the number of apertures arranged at a smaller pitch causes a drop of the air pressure and the apertures of a too small diameter results insufficiency of air supply. Both cases result in difficulty in the formation of piles. However, too large apertures causes that excessive pressure to be applied to the composite 1 with the result that unsatisfactory piles are obtained. Too high an air pressure puts the texture of the textile structure 1a into disorder, whereas too low an air pressure makes it difficult to form piles.

In carrying out the present invention, the optimum conditions should preferably be determined through preliminary testing.

A pile-surfaced textile structure 6 of a lengthwisely striped pattern may be obtained by varying the jetting pressure of compressed air, as viewed widthwise of the composite 1. This is achieved by an irregular arrangement of the apertures. A pile-surfaced textile structure 6 of a crosswisely striped pattern may be obtained by intermittent jetting of compressed air.

The thus obtained pile-surfaced textile structure 6 is rolled around a take-up machine 7.

Figure 3:
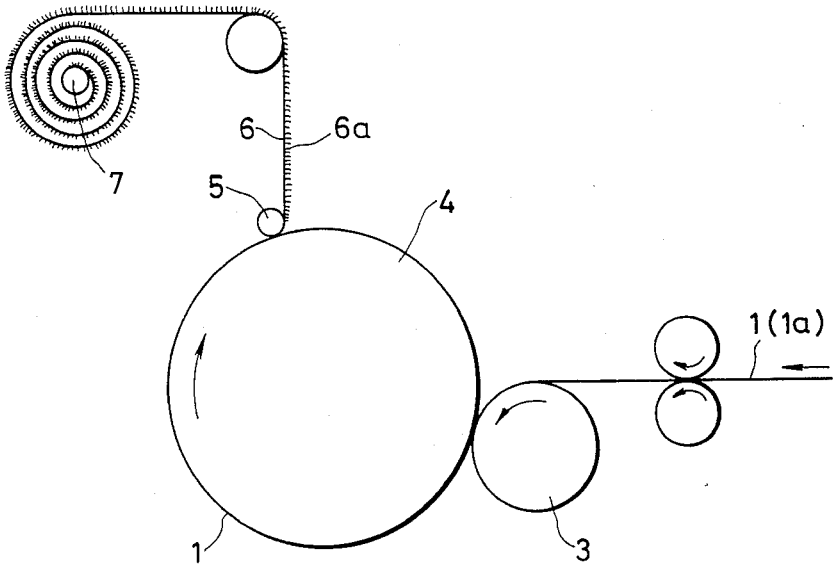
FIG. 3 illustrating the preparation of a composite formed of a textile structure per se.

As illustrated in FIGS. 1 to 3, the present invention can be carried out by simple means, using the textile structure 1a produced in a separate step.

FIG. 4 shows one embodiment of the apparatus used for the simultaneous preparation of the textile structure 1a and the pile-surfaced textile structure 6, with which the present invention can be carried out in a simpler manner.

First, the fibers for the partly melting textile structures such as the mixed fiber textile structure or composite fiber textile structure are formed into wet process webs having a given weight with a paper machine. The webs are then carried to a Yankee drier 8 of FIG. 4 where they are heated to the said given temperature, so that wet process non-woven fabric 1a' is obtained through the heat fusion of the low-melting point thermoplastic resin forming the low-melting linear mass (see Japanese Patent Application Laid-open No. 54-2,479 specification). The thus obtained wet process non-woven fabric is then separated from the Yankee drier 8 by means of a doctor knife 9, and air jets are immediately injected therethrough from the air jet injector 5. In this way, the preparation of the wet process non-woven fabric 1a' as the textile structure 1a and the pile-surfaced textile structure 6 having piles 6a is effected simultaneously. This simple method is also applicable to the preparation of heat fusion type non-woven fabrics from composite fibers by dry process with the use of a webber such as a carding machine and a heating roll. In this case, air jets are injected through the non-woven fabric just after the separation thereof from the heating roll.

The piles of thus obtained pile-surfaced textile structure do not separate from the backing material, since they are formed from the backing material to which they are fused in spread base. According to the present invention, a variety of pile-surfaced textile structures are obtained by applying various combinations of textile structures and low-melting point thermoplastic resins and modifying the air-jetting conditions at low costs with the aid of the simpler apparatus involving reduced steps.

The present invention will be further explained with reference to the following non-restrictive examples.

EXAMPLE 1

The apparatus of FIG. 2 was used. As the textile structure, use was made of heat fusion type non-woven fabric (hereinafter referred to as the ES non-woven fabric) comprising composite fibers (marketed by Chisso Corporation under the tradename of "ES" fiber) containing as the low-melting point component polyethylene and as the high-melting point component polypropylene. The polyethylene had a melting point of 135° C., and ES non-woven fabric had a weight of 30 $g/m^2$ and an air-permeability of 240 $cm^3/cm^2$ sec. As the low-melting point thermoplastic resin, a copolymer of ethylene and vinyl acetate (referred to as the EVA)—vinyl acetate content: 10 mole %, melt index: 25, melting point: 105° C.—was used. The EVA was coated to a thickness of 2 mm onto the heating roll of 130° C. (a metal roll plated with Cr), and the ES non-woven fabric was fed in between the heating roll and the nip roll, whereby the EVA was coated onto the non-woven fabric to form a composite. The composite was separated from the heating roll, and an air jet was immediately injected through the ES non-woven fabric. The air jet injector used comprised a tube having an inner diameter of 11.5 mm and a plurality of apertures of 1 mm in diameter at a pitch of 2.5 mm, and generated air jets of 5 $Kg/cm^2G$.

The thus formed piles had a mean length of 3 mm and a mean denier of 0.06 D/F (D: denier, F: filament). The obtained pile-surfaced textile structure has been found to be suitable for use in the facing material for diapers, and soft to the touch. Since the materials were all composed of water repellent materials, the textile structure has been found to show good spot penetration of liquid, in other words the textile structure prevents the liquid from spreading in the facing material and make the liquid penetrate into the wadding of the diaper.

EXAMPLE 2

The apparatus of FIG. 1 was employed. As the textile structure, use was made of fabric (weight: 300 $g/m^2$, air-permeability: 50 $cm^3/cm^2$ sec.) obtained by weaving polyethylene terephthalate fibers of 1/20'S, and as the low-melting point thermoplastic resin film, use was made of a 100 $\mu$-thick high-density polyethylene film colored with phthalocyanine green (specific gravity: 0.960, melt index: 10, melting point: 130° C.). Lamination was effected to obtain a composite. The composite was supplied to the heating roll 4 of 150° C. (a metal roll plated with Cr) to melt the film at a contact pressure of 6 Kg/cm. The composite was separated from the roll, and air jets were immediately injected through the composite from the side of the fabric. The air jet injector used had an inner diameter of 20 mm and was provided with a plurality of apertures of 2 mm in diameter at a pitch of 5 mm. This injector was generated air jets of 10 $Kg/cm^2$. The thus obtained pile-surfaced textile structure having film-like piles with a mean length of 15 mm and a mean thickness of 15 microns has been found to show good resistance to light and good cushioning properties, and be suitable for use in artificial lawn to be laid by pool sides.

EXAMPLE 3

The apparatus of FIG. 3 was employed. A card web was supplied to the heating roll of 130° C., which comprised a 2:1 mixture of polyethylene terephthalate base sheathcore type heat fusible composite fiber (sold by Unichika under the tradename of MELTY, melting point of the low-melting component: 90° C.) ($4^D \times 51$ mm) and polyethylene terephthalate fibers (melting point: 250° C.) ($2^D \times 51$ mm), and the low-melting part thereof was fused at a contact pressure of 4 $Kg/cm^2$ to obtain non-woven fabric. The non-woven fabric was separated from the heating roll, and air jets were immediately injected therethrough. The air jet having an inner diameter of 10 mm was provided with a plurality of apertures of 0.5 mm in diameter at a pitch of 1.5 mm, and generated air jets of 2 $Kg/cm^2$. The thus obtained textile structure having piles with a mean length of 2 mm and a mean denier of 0.02 D/F has been found to be suitable for use in the liner material for diaper.

EXAMPLE 4

The apparatus as illustrated in FIG. 2 was employed, and the heating roll of 230° C. (a metal roll plated with Ni-Cr) as adapted to rotate at a peripheral speed of 6 m/min. To this roll was coated at a thickness of about 3 mm polyprophylene mixed with a flame retardant (a 2:1 mixture of decabromodiphenyl oxide and $Sb_2O_3$) and a beige organic pigment. To this roll was also fed a needle-punched non-woven fabric (weight: 80 $g/m^2$, air-permeability: 150 $cm^3/cm^2$ sec.) of black-dyed "CODELAN" ($15^D \times 64^F$, manufactured by Kojin), thereby to coat one side of the non-woven fabric with polypropylene. The thus coated fabric was separated from the roll, and air jets were soon intermittently injected therethrough. The air jet injector having an inner diameter of 15 mm was provided with a plurality of apertures of 1.5 mm in diameter at a pitch of 10 mm, and generated air jets of 10 $Kg/cm^2$. Air jetting for 0.1 second following stop for 0.1 second was repeatedly effected through the operation of a valve. The thus obtained pile-surfaced textile structure having polypropylene piles with a mean length of 5 mm at an interval of 10 mm had been found to excel in flame retardancy and durability as well as in design from its lattice pattern and color. This textile structure is best-suited for use in textile wall materials.

EXAMPLE 5

The apparatus of FIG. 4 was employed. Polyethylene fibers ($3^D \times 10$ mm) prepared by spinning of a linear low-density polyethylene having a melting point of 125° C. were mixed with polyethylene terephthalate fibers ($2^D \times 6$ mm) in a proportion of 60:40 to form a wet process web having a dry weight of ca.30 $g/m^2$. In a way similar to that for the production of wet process non-woven fabrics using polyethylene fibers as a binder, the wet process was carried to the Yankee drier of 140° for heat fusion. The thus obtained wet process non-woven fabric was separated from the drier by a doctor knife, and air jets were immediately injected therethrough. The air jet injector having an inner diameter of 20 mm was provided with a plurality of apertures of 1 mm in diameter at a pitch of 2 mm and generated air jets of 7 $Kg/cm^2G$. The thus formed textile structure having fine and soft polyethylene piles with a mean length of 1 mm has been found to possess heat sealable properties and high grade feeling. Thus, this textile structure has been found to be suitable for wrapping of cakes.

What is claimed is:

1. A process for the production of a pile-surfaced textile structure which comprises the steps of: forming a composite by adhering a low-melting point thermoplastic resin material to one side of a substantially flat sheet of backing material by melting said resin material, said resin material becoming molten when heated at a given temperature and said backing material being an air-permeable textile structure which remains substantially intact and is not softened upon being heated at a given temperature; heating said composite at said given temperature to melt said resin material; and injecting an air-jet through said heated composite form the side of said backing material which is opposite said resin material so that said resin is projected into fibrous forms which form a pile surface on said composite.

2. The process as recited in claim 1 wherein said composite comprises a textile structure onto which a low-melting point thermoplastic resin is coated:

3. The process as recited in claim 1 wherein said composite comprises a textile structure onto which a low-melting point thermoplastic resin is laminated.

4. A process for the production of a pile-surfaced textile structure comprising the steps of: preparing a composite, said composite being composed of an air-permeable backing material consisting of a high-melting point linear mass which forms a first part of said textile structure, and is not softened and thus remains substantially intact upon being heated at a given temperature, and a low-melting point thermoplastic resin material composed of a low-melting point linear mass which forms a second part of said textile structure and is molten by heating at said given temperature; heating said composite to said given temperature to melt said low-melting point thermoplastic resin; and injecting an air jet through one side of said heated composite to the other side of said heated composite, in such a manner that said low-melting point thermoplastic resin is projected into fibrous form to form piles.

5. The process as recited in claim 4, wherein said composite comprises a textile structure composed of a fiber mixture of high-melting point fibers undergoing no softening by heating at said given temperature and low-melting point fibers consisting of thermoplastic resin undergoing melting at said given temperature, said high-melting point fibers serving as said high-melting linear mass forming said backing material, and said low-melting point fibers serving as said low-melting point linear mass forming said low-melting point thermoplastic resin material.

6. The process as recited in claim 4, wherein said composite comprises a textile structure at least partly containing composite fibers composed of a high-melting point component which is not softened by heating at said given temperature and a low-melting point component of thermoplastic resin which forms partly or wholly the surface of said composite fibers and which is molten by heating at said given temperature, said high-melting point component of composite fibers serving as said high-melting point linear mass forming at least part of said backing material, and said low-melting point component thereof serving as said low-melting point linear mass forming said low-melting point thermoplastic resin material.

* * * * *